US005234251A

United States Patent [19]

Ayotte

[11] Patent Number: 5,234,251

[45] Date of Patent: Aug. 10, 1993

[54] SEAT ARM ATTACHMENT

[75] Inventor: John P. Ayotte, Eagan, Minn.

[73] Assignee: MTS Northwest Sound, Inc., Minneapolis, Minn.

[21] Appl. No.: 882,470

[22] Filed: May 13, 1992

[51] Int. Cl.[5] ..... A47C 7/62

[52] U.S. Cl. ..... 297/194; 297/411.26; 248/311.2

[58] Field of Search ..... 297/194, 218, 227, 411, 297/414, 416, 188; 248/311.2, 118

[56] References Cited

U.S. PATENT DOCUMENTS

| | | | |
|---|---|---|---|
| 3,136,426 | 6/1964 | Sakuma | 248/311.2 X |
| 4,331,360 | 5/1982 | Rondybush et al. | 297/411 X |
| 4,613,048 | 9/1986 | McGill | 297/194 X |
| 4,863,134 | 9/1989 | Young et al. | 248/118 X |

*Primary Examiner*—Laurie K. Cranmer
*Attorney, Agent, or Firm*—Kinney & Lange

[57] ABSTRACT

An arm attachment for mounting on the arm or standard of a seat. The arm attachment comprises a main body having a container holder and an armrest insert support with an armrest insert that can be removed. The armrest insert support has an elongated box shape while the container holder has a generally cylindrical shape. The armrest insert support has a recess and has a slot at one end for receiving a tongue at a first end of the armrest insert. The armrest insert is inserted into the recess which can receive a variety of armrest inserts. The container holder is capable of receiving a holder insert with ledges for holding containers of different sizes. The arm attachment is mounted on the arm or standard of a seat by a plurality of screws.

10 Claims, 5 Drawing Sheets

SEAT ARM ATTACHMENT

BACKGROUND OF THE INVENTION

The present invention relates to a container or cup holder which can be mounted on the arm or standard of a seat, and in particular to a combination container holder and armrest in which the armrest can be removed and replaced.

In stadiums, arenas and theaters a common problem is the lack of a place to rest beverage or popcorn containers. Often, containers are placed on the floor or on the arm of a seat only to be accidentally knocked over or otherwise spilled. In the alternative, the occupant of a seat must hold the containers, thereby restricting the use of his hands.

A number of container holders have been used to alleviate the problem mentioned above. One type is mounted on the back of a seat to hold the container of the occupant of the seat directly behind. A second type of container holder is adapted to be mounted on the arm or standard of a seat. Such a device is shown in U.S. Pat. No. 4,795,211.

Prior art devices disclosing these types of container holders have shown holders without an armrest or with only one type of armrest that cannot be removed. If the armrest becomes worn or is defaced, the entire apparatus must be replaced. The entire apparatus must also be replaced if it is desired to change from a durable to a more comfortable padded armrest or vice versa.

Therefore, it is desirable to have a combination container holder and armrest which can be securely mounted on an arm or a standard of a seat and which allows for the removal and replacement of the armrest.

SUMMARY OF THE INVENTION

The present invention provides an arm attachment which can be mounted on an arm or a standard of a seat. The arm attachment comprises a main body having an armrest insert support and a container holder. The container holder has a generally cylindrical shape and allows a container to be securely held at a position easily reached by the occupant of the seat. The armrest insert support has a generally elongated box shape and has a removable armrest insert that allows for the use of more than one type of armrest insert and for the replacement of the armrest insert when it becomes worn.

The arm attachment has a recess that extends substantially the length of the armrest insert support and is made to receive the armrest insert. There is more than one type of armrest insert and each has a tongue at one end which fits into a slot, accessible only from the recess, at a first end of the armrest insert support. Each type of armrest insert alternately can have a slot at one end into which can fit a tongue formed at a first end of the armrest insert support. A second end of the armrest insert support has a hole for a screw which is inserted through the hole and threaded into the armrest insert.

The container holder is open at a first end and has a circular opening at a second end. The container holder is capable of receiving a holder insert which allows containers of different sizes to be held through the use of a series of annular ledges on which a container may rest.

The arm attachment is adjustable to fit many types of seats and is attached to the arm or standard of a seat through the use of a number of screws. The screws are inserted through openings in the bottom of the armrest and screwed into the existing arm or standard of the seat.

DETAILED DESCRIPTION OF THE PREFERRED EMBODIMENTS

Figure 1:
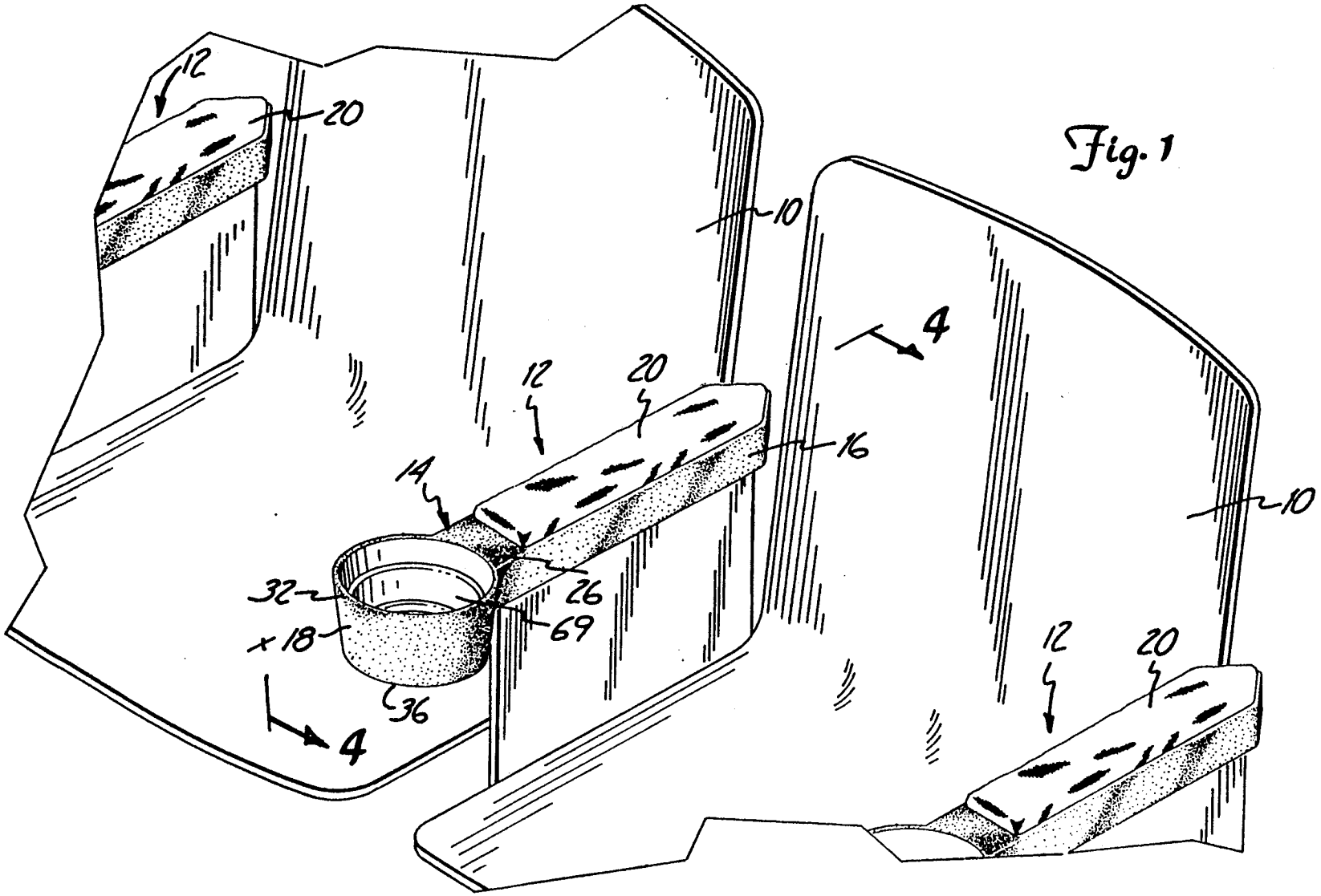
FIG. 1 is a perspective view of a seat with the arm attachment of the present invention mounted thereon.
Figure 2:
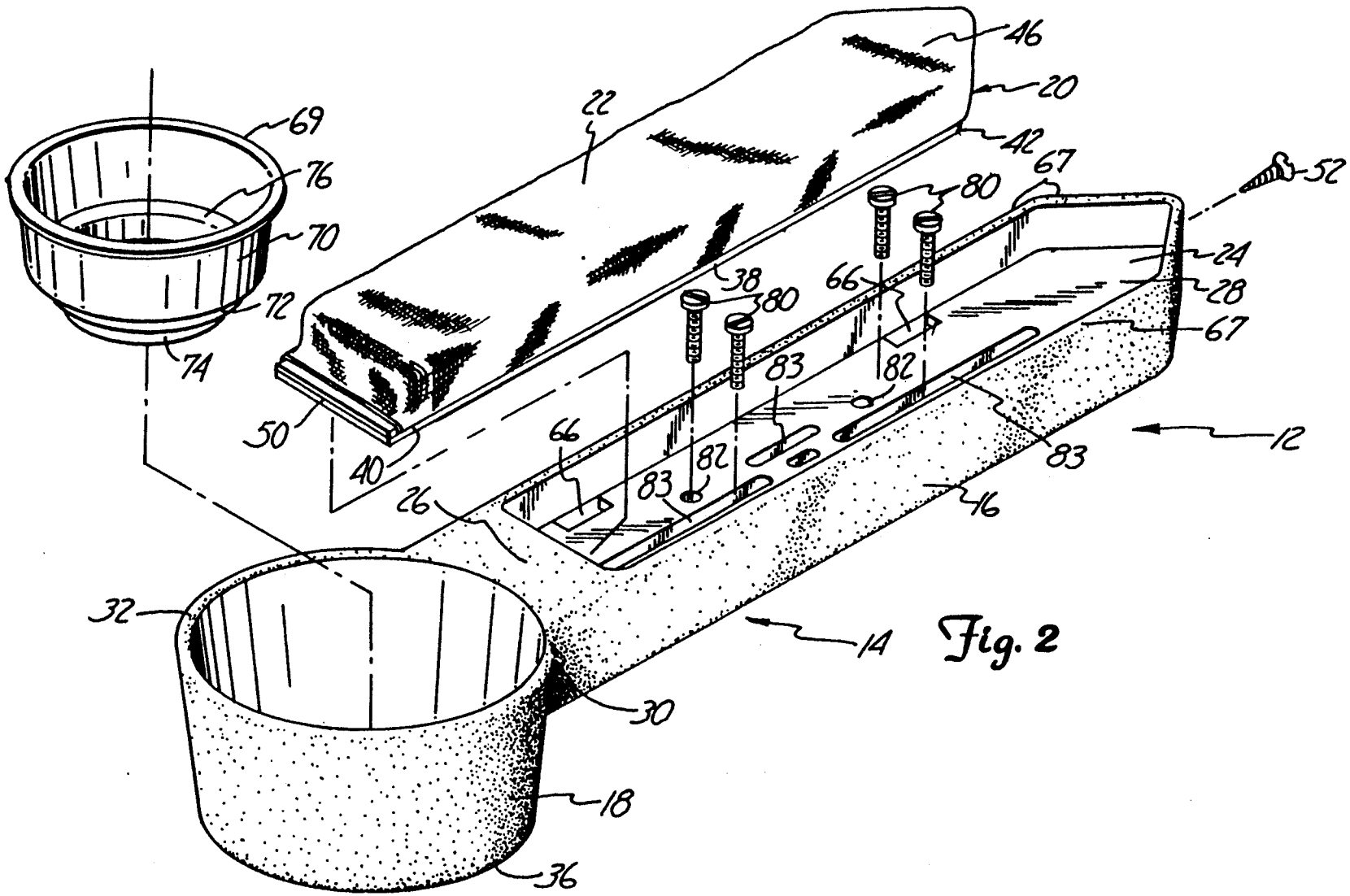
FIG. 2 is an exploded perspective view of the arm attachment with a padded armrest insert.
Figure 3:
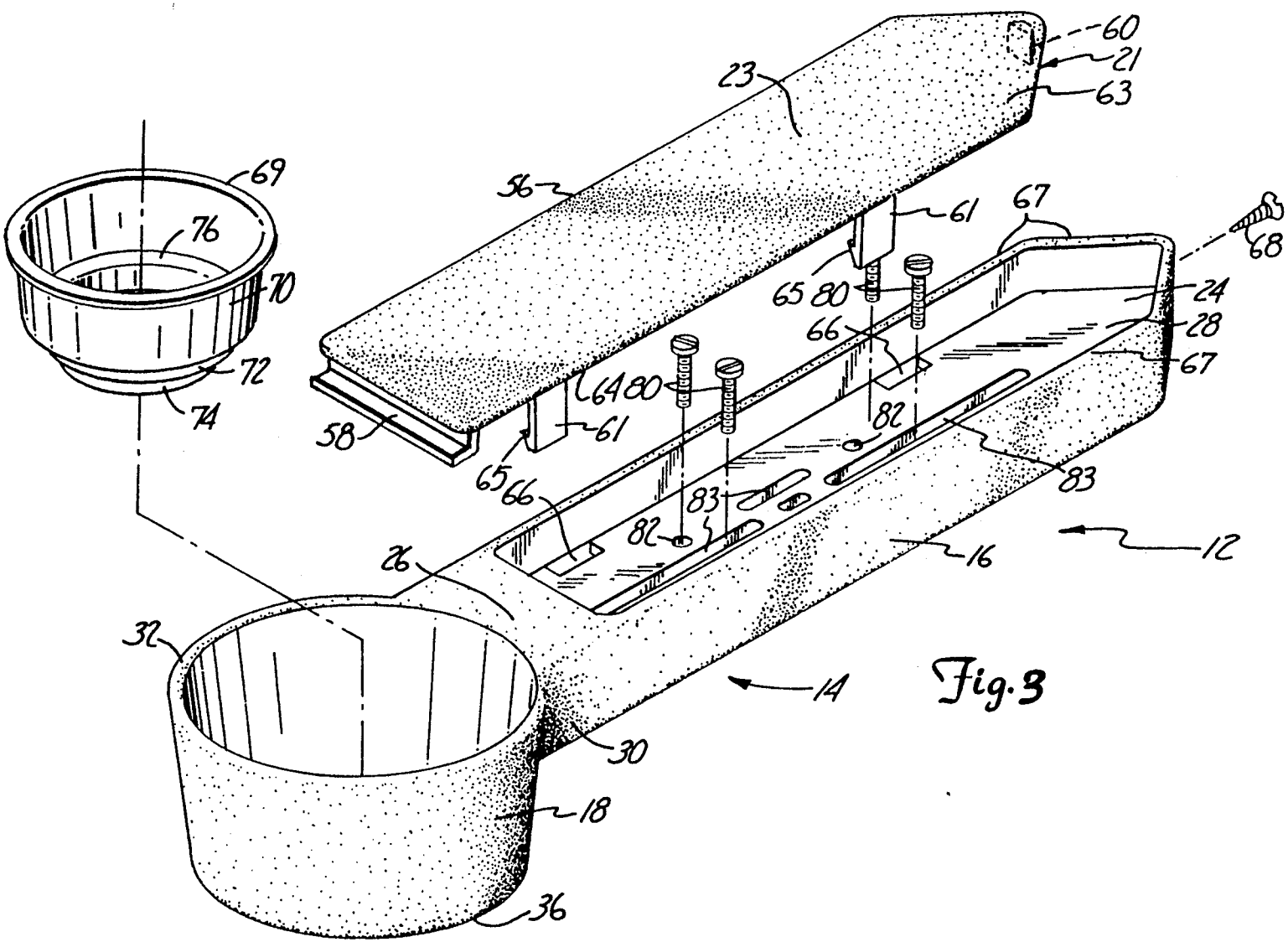
FIG. 3 is an exploded perspective view of the arm attachment with an unpadded armrest insert.

A seat 10 has a standard 11 on which an arm attachment 12 of the present invention is mounted. The arm attachment 12, shown in FIG. 2, comprises a main body 14 consisting of an armrest insert support 16 and a container holder 18. A padded armrest insert 20 is attached to the main body 14. The same arm attachment 12 is shown in FIG. 3 with an unpadded armrest insert 21. The padded armrest insert 20 and the unpadded armrest insert 21 provide a padded upper surface 22 and an unpadded upper surface 23 respectively, for supporting an arm of a user.

The armrest insert support 16 has an elongated box shape and has a generally rectangular recess 24 in an upper surface 26. The recess 24 has a flat bottom surface 28 and extends for substantially the entire length of the armrest insert support 16. In addition, the armrest insert support 16 has a first opening or slot 29 at a first end 30 and a second opening 31 at an opposite end. The recess 24 has a size that permits it to receive the padded armrest insert 20 or the unpadded armrest insert 21.

The container holder 18 is integrally molded at the first end 30 of the armrest insert support 16 and has the general shape of a cylinder. The container holder 18 is open at a first end 32 and has a circular opening 34 at a second end 36. The first end 32 of the container holder 18 is flush with the upper surface 26 of the armrest 16.

Figure 4:
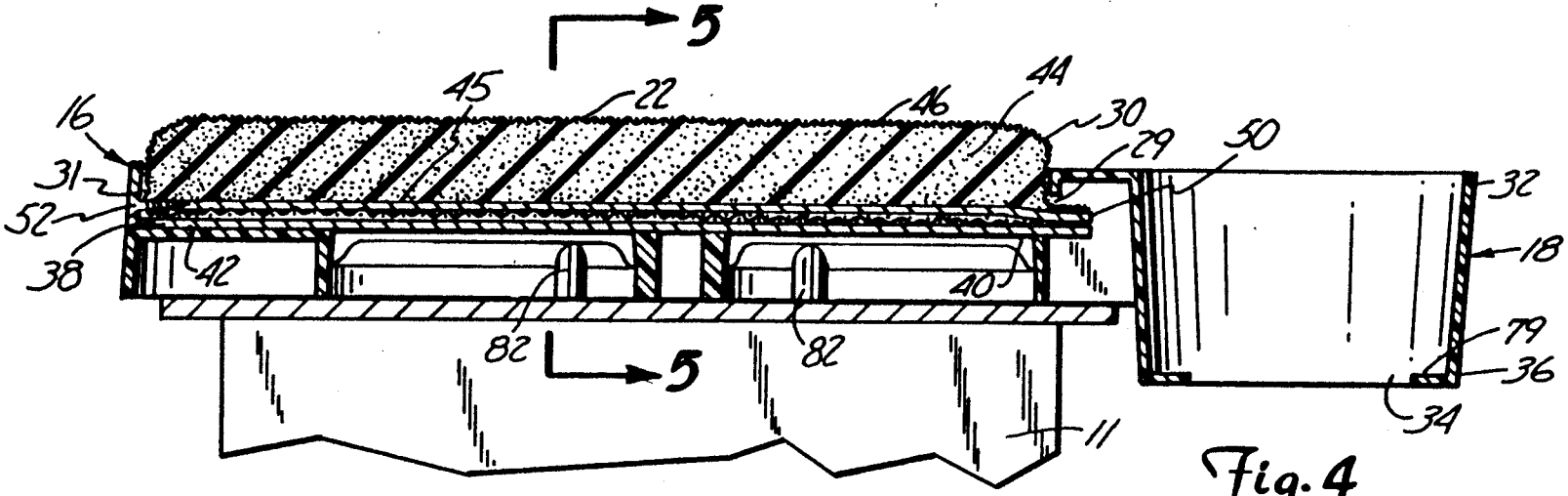
FIG. 4 is a sectional view of the arm attachment with the holder insert removed taken along the line 4—4 of FIG. 1.
Figure 5:
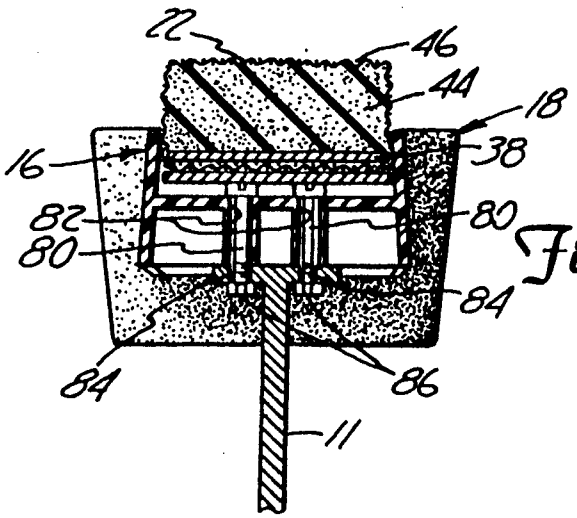
FIG. 5 is a sectional view of the arm attachment taken along the 5—5 of FIG. 4.

The padded armrest insert 20, shown inserted in the recess 24 in FIGS. 4 and 5, comprises a rigid base 38 having a first end 40 and a second end 42. Padding 44 is attached to an upper side 45 of the base 38 and is covered by a cloth covering 46 which is fastened to the base 38 through the use of glue, staples or similar methods. The first end 40 of the base 38 extends beyond the padding 44 and the covering 46 to form a relatively thin tongue 50.

The padded armrest insert 20 is inserted into and covers the recess 24 and is held in place at both the first end 40 and the second end 42 of the base 38. The first end 40 of the base 38 is inserted and secured to the armrest insert support 16 by pushing the tongue 50 into the slot 29 in the armrest insert support 16. The second end 42 of the base 38 is then inserted by pushing it firmly into the recess 24. The second end 42 of the base 38 is secured to the armrest insert support 16 by inserting a screw 52 through the second opening 31 in the armrest insert support 16 and into the second end 42 of the base 38 of the padded armrest insert 20.

The padded armrest insert 20 can be removed from the recess 24 by first removing the screw 52 and then lifting the padded armrest insert 20 by the padding 44 at the second end 42 of the base 38 and pulling the padded armrest insert 20 in a direction away from the slot 29. A new padded armrest insert 20 or an unpadded armrest insert 21 can then be inserted into the recess 24.

FIG. 3 shows the arm attachment 12 with the unpadded armrest insert 21 which comprises a single plastic piece having a top wall 56, a tongue 58, an end tab 60, and four interlocking tabs 61. The tongue 58 extends from a first end 62 of the top wall 56. The tongue 58 can have any desired shape and can be a lug, projection or other interfitting member. The end tab 60 extends from a second end 63 of the top wall 56 and the interlocking tabs 61 extend from a first surface 64 of the top wall 56.

A first end 65 of each interlocking tab 61 is shaped such that it fits through a corresponding one of four tab holes 66 in the armrest insert support 16 and snaps into an interlocking position once through the tab hole 66. The top wall 56 extends over the edges 67 of the armrest insert support 16 when the unpadded armrest insert 21 is inserted into the recess 24. In addition, the end tab 60 aligns with the second opening 31 in the armrest insert support 16 when the unpadded armrest insert 21 is inserted into the recess 24.

The unpadded armrest insert 21 is inserted into the recess 24 and secured to the armrest insert support 16 in a manner similar to the padded armrest insert 20. First, the tongue 58 is pushed into the slot 29. The second end 63 of the top wall 56 is then pushed toward the recess 24 until the top wall 56 comes into contact with the edges 67 of the armrest insert support 16 and each interlocking tab 61 is pushed through its corresponding tab hole 66. Finally, a self-tapping screw 68 is inserted through the second opening 31 of the armrest insert support 16 and screwed into the end tab 60 to secure the unpadded armrest insert 21 to the armrest insert support 16.

Figure 6:
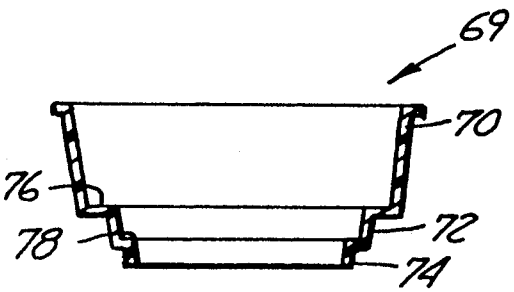
FIG. 6 is a sectional view of the holder insert.

FIG. 6 shows an optional holder insert 69 which comprises a single plastic piece. The holder insert 69 has three concentric sections 70, 72, 74 each having a generally tubular shape and a lip at a first end. The first section 70 has a larger diameter than does the second section 72 which has a larger diameter than does the third section 74. The lips of the second and third sections 72, 74 are integral with the second ends of the first and second sections 70, 72 respectively, to form a first annular ledge 76 and a smaller second annular ledge 78 in the holder insert 69. The bottom of a container can rest on either the first ledge 76 or the second ledge 78, allowing the holder insert 69 to hold containers of more than one size.

When used, the holder insert 69 is axially inserted into the container holder 18 so that a second end of the third section 74 fits through the circular opening 34 in the container holder 18. The holder insert 69 is then firmly pushed toward the circular opening 34 until the bottom of the second ledge 78 comes into contact with a bottom 79 of the container holder 18.

The arm attachment 12 is attached to the standard 11 of the seat 10 by a plurality of mounting screws 80, each of which is inserted through a hole 82 or a mounting slot 83 in the armrest insert support 16, and a corresponding hole 84 drilled in the standard 11. Each mounting screw 80 is then secured with a nut 86.

Figure 7:
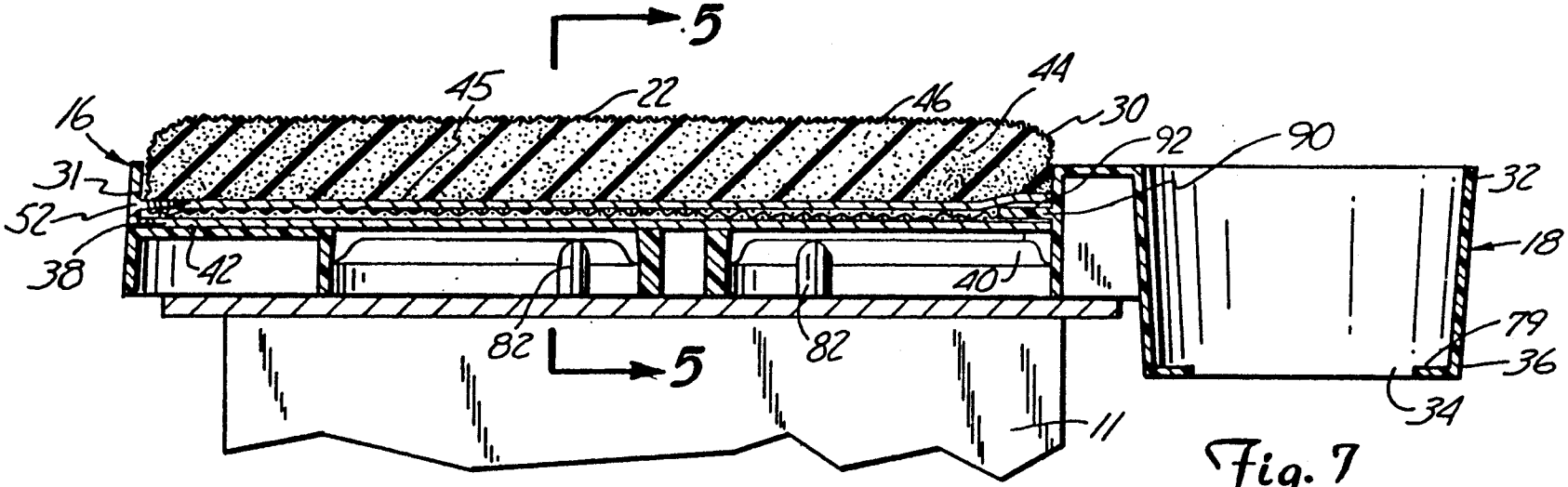
FIG. 7 is a sectional view of a modified form of the arm attachment with the holder insert removed.

In a first alternative embodiment of the arm attachment 12, shown in FIG. 7 the a tongue 90 can be at the first end 30 of the armrest insert support 16. Further, a slot 92 can extend from the first end 62 of the top wall 56 of the unpadded armrest insert 21 or be at the first end 40 of the base 38 of the padded armrest insert 20. In the first alternative embodiment, the padded armrest insert 20 and the unpadded armrest insert 21 are inserted into the recess 24 in a manner similar to the preferred embodiment having the slot 29 in the armrest insert support 16.

Although the present invention has been described with reference to preferred embodiments, workers skilled in the art will recognize that changes may be made in form and detail without departing from the spirit and scope of the invention.

What is claimed is:

1. An arm attachment for use with a seat having an arm, the arm attachment comprising:

a main body having an armrest portion having a recess, and a container holder portion at an end thereof;

an armrest insert extending substantially the entire length of the armrest portion and capable of being releasably attached to the armrest portion to cover the recess; and means for mounting the main body on the arm of the seat.

2. The apparatus according to claim 1 wherein the armrest insert has a tongue at a first end and the armrest portion of the main body has a slot to receive the tongue, the tongue being inserted into the slot for retaining the armrest insert in the recess.

3. The apparatus according to claim 1 wherein the armrest portion of the main body has a tongue and the armrest insert has a slot at a first end to receive the tongue, the tongue being inserted into the slot for retaining the armrest insert in the recess.

4. The apparatus according to claim 1 wherein the armrest insert is padded and an upper surface of the armrest insert is covered with cloth.

5. The apparatus according to claim 1 wherein an upper surface of the armrest insert is plastic.

6. The apparatus according to claim 1 wherein the container holder portion has a generally cylindrical shape, is open at a first end and has a circular opening at a second end.

7. The apparatus according to claim 6 wherein the container holder portion is capable of receiving a holder insert having a plurality of ledges for holding containers of different sizes.

8. An arm attachment for use with a seat having an arm, the arm attachment comprising:

a main body, having an armrest portion having a recess, an armrest hole in a first end thereof, and a container holder portion at a second end thereof;

an armrest insert having a tongue extending from a first end thereof, an end tab extending from a second end thereof and a plurality of interlocking tabs extending from a first surface thereof, the armrest insert capable of being releasably attached to the armrest portion of the main body to cover the recess;

a slot at the second end of the armrest portion of the main body, the slot being capable of receiving the tongue;

a screw inserted through the armrest hole and the tab to releasably secure the armrest insert to the main body; and means for mounting the main body on the arm of the seat.

9. An arm attachment for use with a seat having a standard, the arm attachment comprising:

a main body having an armrest portion having a recess, and a container holder portion at an end thereof;

an armrest insert extending substantially the entire length of the armrest portion and capable of being releasably attached to the armrest portion to cover the recess; and means for mounting the main body on the standard of the seat.

10. An arm attachment for use with a seat having an arm, the arm attachment comprising:

a main body having an armrest portion having a recess, and a container holder portion at an end thereof;

a padded armrest insert capable of supporting a substantial part of a human arm and capable of being releasably attached to the armrest portion to cover the recess; and means for mounting the main body on the arm of the seat.

* * * * *

UNITED STATES PATENT AND TRADEMARK OFFICE

CERTIFICATE OF CORRECTION

PATENT NO. : 5,234,251

DATED : August 10, 1993

INVENTOR(S) : JOHN P. AYOTTE

It is certified that error appears in the above-identified patent and that said Letters Patent is hereby corrected as shown below:

On the Title Page, in the [56] References Cited section, under U.S. PATENT DOCUMENTS, insert:

4,795,211 1/1989 Stern et al.....297/194

Signed and Sealed this

Fifth Day of April, 1994

*Attest:*

*Attesting Officer*

Bruce Lehman

BRUCE LEHMAN

*Commissioner of Patents and Trademarks*

US005234251C1

(12) EX PARTE REEXAMINATION CERTIFICATE (5904th)

United States Patent
Ayotte

(10) Number: US 5,234,251 C1
(45) Certificate Issued: Oct. 2, 2007

(54) SEAT ARM ATTACHMENT

(75) Inventor: John P. Ayotte, Eagan, MN (US)

(73) Assignee: Caddy Products, Inc., Minneapolis, MN (US)

Reexamination Request:
No. 90/007,862, Dec. 27, 2005

Reexamination Certificate for:

| | |
|---|---|
| Patent No.: | **5,234,251** |
| Issued: | **Aug. 10, 1993** |
| Appl. No.: | **07/882,470** |
| Filed: | **May 13, 1992** |

Certificate of Correction issued Apr. 5, 1994.

(51) Int. Cl.
*A47C 7/62* (2006.01)

(52) U.S. Cl. ..... 297/188.14; 248/311.2; 297/188.2; 297/411.26

(58) Field of Classification Search ..... None
See application file for complete search history.

(56) References Cited

U.S. PATENT DOCUMENTS

| | | | |
|---|---|---|---|
| 334,756 | A | 1/1886 | Denver |
| 1,036,421 | A | 8/1912 | Barker et al. |
| 1,402,292 | A | 1/1922 | Heck |
| 2,419,412 | A | 4/1947 | McArthur |
| 3,068,048 | A | 12/1962 | Mahon et al. |
| 3,074,762 | A | 1/1963 | Kris |
| 3,118,704 | A | 1/1964 | Meserve |
| 3,137,527 | A | 6/1964 | Hoven et al. |
| 3,170,729 | A | 2/1965 | Grant |
| 3,695,689 | A | 10/1972 | Barecki |
| 4,099,780 | A | 7/1978 | Schmidhuber |
| 4,186,964 | A | 2/1980 | Marrajo et al. |
| 4,331,360 | A | 5/1982 | Roudybush et al. |
| 4,521,056 | A | 6/1985 | Lindenmuth |
| 4,597,606 | A | 7/1986 | Magee |
| 4,613,048 | A | 9/1986 | McGill |
| 4,795,211 | A | 1/1989 | Stern et al. |
| 5,009,468 | A | 4/1991 | Fomby |
| 5,074,617 | A | 12/1991 | Maxwell |

*Primary Examiner*—Peter C. English

(57) ABSTRACT

An arm attachment for mounting on the arm or standard of a seat. The arm attachment comprises a main body having a container holder and an armrest insert support with an armrest insert that can be removed. The armrest insert support has an elongated box shape while the container holder has a generally cylindrical shape. The armrest insert support has a recess and has a slot at one end for receiving a tongue at a first end of the armrest insert. The armrest insert is inserted into the recess which can receive a variety of armrest inserts. The container holder is capable of receiving a holder insert with ledges for holding containers of different sizes. The arm attachment is mounted on the arm or standard of a seat by a plurality of screws.

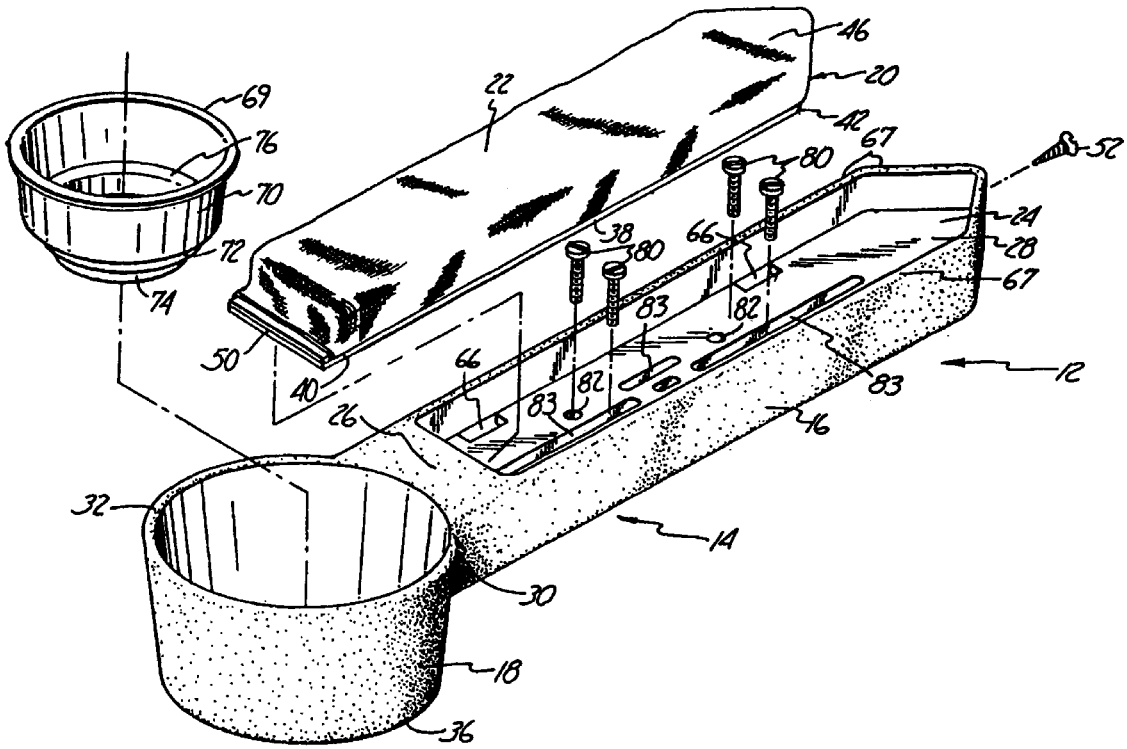

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 8 is confirmed.

Claims 1, 9 and 10 are determined to be patentable as amended.

Claims 2–7, dependent on an amended claim, are determined to be patentable.

1. An arm attachment for use with a seat having an arm, the arm attachment comprising:

a main body having an armrest portion having a recess, and a container holder portion at an end thereof;

an armrest insert extending substantially the entire length of the armrest portion and capable of being releasably attached to the armrest portion to cover the recess *when the main body is secured to the arm of the seat*; and means for mounting the main body on the arm of the seat.

9. An arm attachment for use with a seat having a standard, the arm attachment comprising:

a main body having an armrest portion having a recess, and a container holder portion at an end thereof;

an armrest insert extending substantially the entire length of the armrest portion and capable of being releasably attached to the armrest portion to cover the recess *when the main body is secured to the standard of the seat*; and means for mounting the main body on the standard of the seat.

10. An arm attachment for use with a seat having an arm, the arm attachment comprising:

a main body having an armrest portion having a recess, and a container holder portion at an end thereof;

a padded armrest insert capable of supporting a substantial part of a human arm and capable of being releasably attached to the armrest portion to cover the recess *when the main body is secured to the arm of the seat*; and means for mounting the main body on the arm of the seat.

* * * * *

US005234251C2

(12) EX PARTE REEXAMINATION CERTIFICATE (7015th)

United States Patent
Ayotte

(10) Number: US 5,234,251 C2
(45) Certificate Issued: Aug. 18, 2009

(54) SEAT ARM ATTACHMENT

(75) Inventor: John P. Ayotte, Eagan, MN (US)

(73) Assignee: Caddy Products, Inc., Minneapolis, MN (US)

Reexamination Request:
No. 90/010,036, Oct. 11, 2007

Reexamination Certificate for:

| | |
|---|---|
| Patent No.: | **5,234,251** |
| Issued: | **Aug. 10, 1993** |
| Appl. No.: | **07/882,470** |
| Filed: | **May 13, 1992** |

Reexamination Certificate C1 5,234,251 issued Oct. 2, 2007

Certificate of Correction issued Apr. 5, 1994.

(51) Int. Cl.
*A47C 7/62* (2006.01)

(52) U.S. Cl. ..... 297/194; 297/411.26; 297/188.14; 297/188.2; 248/311.2

(58) Field of Classification Search ..... None
See application file for complete search history.

(56) References Cited

U.S. PATENT DOCUMENTS

| | | | | |
|---|---|---|---|---|
| 3,118,704 | A | 1/1964 | Meserve | |
| 4,099,780 | A | 7/1978 | Schmidhuber | |
| 4,521,056 | A | 6/1985 | Lindenmuth | |
| 4,613,048 | A | 9/1986 | McGill | |
| 4,795,211 | A | 1/1989 | Stern et al. | 297/194 |
| 5,009,468 | A | 4/1991 | Fomby | |
| 5,074,617 | A | 12/1991 | Maxwell | |
| 5,234,251 | A | 8/1993 | Ayotte | |

*Primary Examiner*—Catherine S. Williams

(57) ABSTRACT

An arm attachment for mounting on the arm or standard of a seat. The arm attachment comprises a main body having a container holder and an armrest insert support with an armrest insert that can be removed. The armrest insert support has an elongated box shape while the container holder has a generally cylindrical shape. The armrest insert support has a recess and has a slot at one end for receiving a tongue at a first end of the armrest insert. The armrest insert is inserted into the recess which can receive a variety of armrest inserts. The container holder is capable of receiving a holder insert with ledges for holding containers of different sizes. The arm attachment is mounted on the arm or standard of a seat by a plurality of screws.

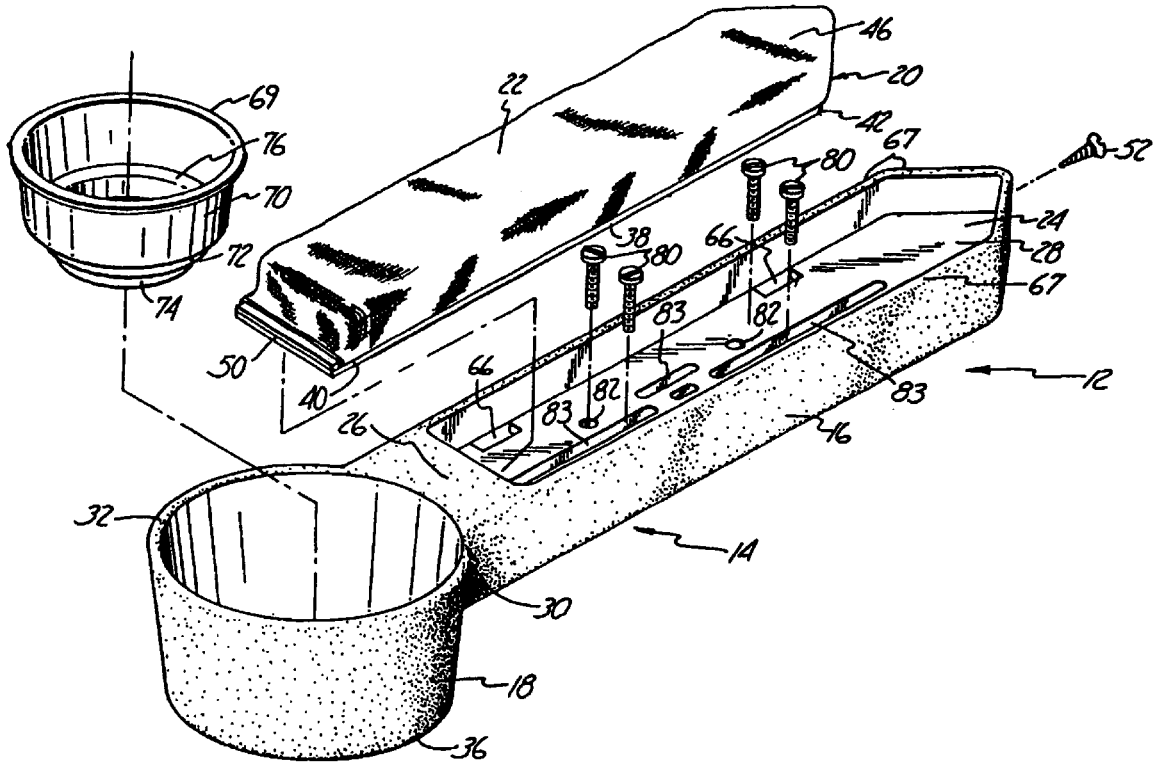

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 9 and 10 are determined to be patentable as amended.

Claims 2–7, dependent on an amended claim, are determined to be patentable.

New claims 11–13 are added and determined to be patentable.

Claim 8 was not reexamined.

1. An arm attachment for use with a seat having an arm, the arm attachment comprising:

a main body having an armrest portion having a recess, and a container holder portion at an end thereof;

an armrest insert extending substantially the entire length of the armrest portion and [capable of being releasably attached to] *entirely detachable from* the armrest portion [to cover] *and when attached covers* the recess when the main body is secured to the arm of the seat; and means for mounting the main body on the arm of the seat, *comprising a screw with a head, the head being positioned within the recess and hidden from view when the insert is attached to the main body, the head being accessible when the armrest insert is entirely detached from the armrest portion*.

9. An arm attachment for use with a seat having a standard, the arm attachment comprising:

a main body having an armrest portion having a recess, and a container holder portion at an end thereof;

an armrest insert extending substantially the entire lenght of the armrest portion and [capable of being releasably attached to] *entirely detachable from* the armrest portion [to cover] *and when attached covers* the recess when the main body is secured to the standard of the seat; and means for mounting the main body on the standard of the seat, *comprising a screw with a head, the head being positioned within the recess and hidden from view when the insert is attached to the main body, the head being accessible when the armrest insert is entirely detached from the armrest portion*.

10. An arm attachment for use with a seat having an arm, the arm attachment comprising:

a main body having an armrest portion having a recess, and a container holder portion at an end thereof;

a padded armrest insert capable of supporting a substantial part of a human arm and [capable of being releasably attached to] *entirely detachable from* the armrest portion [to cover] *and when attached covers* the recess when the main body is secured to the arm of the seat; and means for mounting the main body on the arm of the seat, *comprising a screw with a head, the head being positioned within the recess and hidden from view when the insert is attached to the main body, the head being accessible when the armrest insert is entirely detached from the armrest portion*.

*11. The arm attachment of claim 1 wherein the head of the screw is operable from within the recess for securing the main body to the arm.*

*12. The arm attachment of claim 9 wherein the head of the screw is operable from within the recess for securing the main body to the standard.*

*13. The arm attachment of claim 10 wherein the head of the screw is operable from within the recess for securing the main body to the arm.*

* * * * *

US005234251C3

(12) EX PARTE REEXAMINATION CERTIFICATE (7986th)

United States Patent
Ayotte

(10) Number: US 5,234,251 C3
(45) Certificate Issued: Jan. 11, 2011

(54) SEAT ARM ATTACHMENT

(75) Inventor: John P. Ayotte, Eagan, MN (US)

(73) Assignee: Caddy Products, Inc., Minneapolis, MN (US)

Reexamination Request:
No. 90/010,693, Sep. 21, 2009

Reexamination Certificate for:

| | |
|---|---|
| Patent No.: | **5,234,251** |
| Issued: | **Aug. 10, 1993** |
| Appl. No.: | **07/882,470** |
| Filed: | **May 13, 1992** |

Reexamination Certificate C1 5,234,251 issued Oct. 2, 2007

Reexamination Certificate C2 5,234,251 issued Aug. 18, 2009

Certificate of Correction issued Apr. 5, 1994.

(51) Int. Cl.
*A47C 7/62* (2006.01)

(52) U.S. Cl. ..... 297/188.14; 248/311.2; 297/188.2; 297/411.26

(58) Field of Classification Search ..... 297/188.14
See application file for complete search history.

(56) References Cited

U.S. PATENT DOCUMENTS

| | | | |
|---|---|---|---|
| 3,675,969 | A | 7/1972 | Gage |
| 4,099,780 | A | 7/1978 | Schmidhuber |
| 4,521,056 | A | 6/1985 | Lindenmuth |
| 4,613,048 | A | 9/1986 | McGill |
| 4,795,211 | A | 1/1989 | Stern et al. |
| 5,009,468 | A | 4/1991 | Fomby |
| 5,074,617 | A | 12/1991 | Maxwell |
| 5,234,251 | A | 8/1993 | Ayotte |
| 5,234,251 | B1 | 8/1993 | Ayotte |
| 5,234,251 | B2 | 8/1993 | Ayotte |

*Primary Examiner*—Cary E. Wehner

(57) ABSTRACT

An arm attachment for mounting on the arm or standard of a seat. The arm attachment comprises a main body having a container holder and an armrest insert support with an armrest insert that can be removed. The armrest insert support has an elongated box shape while the container holder has a generally cylindrical shape. The armrest insert support has a recess and has a slot at one end for receiving a tongue at a first end of the armrest insert. The armrest insert is inserted into the recess which can receive a variety of armrest insert. The container holder is capable of receiving a holder insert with ledges for holding containers of different sizes. The arm attachment is mounted on the arm or standard of a seat by a plurality of screws.

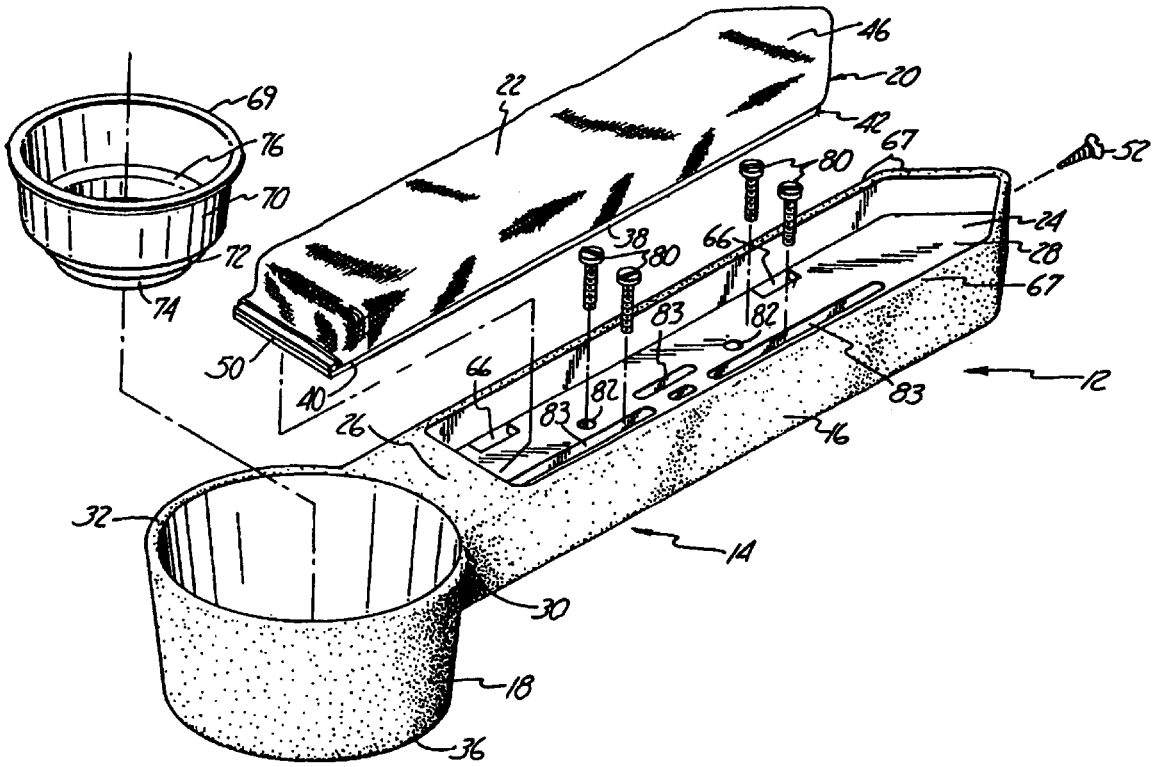

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10 and 13 is confirmed.

Claims 1, 7 and 9 are determined to be patentable as amended.

Claims 2-6, 11 and 12, dependent on an amended claim, are determined to be patentable.

New claims 14 and 15 are added and determined to be patentable.

Claim 8 was not reexamined.

1. An arm attachment for use with a seat having an arm, attachment comprising:

a main body having an armrest portion *extending substantially an entire length of the arm, the armrest portion* having a recess, and a container holder portion at an end thereof;

an armrest insert extending substantially [the] *an* entire length of the armrest portion and entirely detachable from the armrest portion and when attached covers the recess when the main body is secured to the arm of the seat; and means for mounting the main body on the arm of the seat, comprising a screw with a head, the head being positioned within the recess and hidden from view when the insert is attached to the main body, the head being accessible when the armrest insert is entirely detached from the armrest portion.

7. The apparatus according to the claim 6 wherein the container holder portion [is capable of receiving] *receives* a holder insert having a plurality of ledges for holding containers of different sizes.

9. An arm attachment for use with a seat having a standard, the arm attachment comprising:

a main body having an armrest portion *extending substantially an entire length of the standard, the armrest portion* having a recess, and a container holder portion at an end thereof;

an armrest insert extending substantially [the] *an* entire length of the armrest portion and entirely detachable from the armrest portion and when attached covers the recess when the main body is secured to the standard of the seat; and means for mounting the main body on the standard of the seat, comprising a screw with a head, the head being positioned within the recess and hidden from view when the insert is attached to the main body, the head being accessible when the armrest insert is entirely detached from the armrest portion.

*14. An arm attachment for use with a seat having an arm, the arm attachment comprising:*

*a main body having an armrest portion extending substantially an entire length of the arm, the armrest portion having a recess, and a container holder portion at an end thereof;*

*an armrest insert extending substantially an entire length of the armrest portion and entirely detachable from the armrest portion and when attached covers the recess when the main body is secured to the arm of the seat, wherein the armrest insert has a tongue at a first end and the armrest portion of the main body has a slot to receive the tongue, the tongue being inserted into the slot for retaining the armrest insert in the recess; and*

*means for mounting the main body on the arm of the seat, comprising a screw with a head, the head being positioned within the recess and hidden from view when the insert is attached to the main body, the head being accessible when the armrest insert is entirely detached from the armrest portion.*

*15. An arm attachment for use with a seat having an arm, the arm attachment comprising:*

*a main body having an armrest portion extending substantially an entire length of the arm, the armrest portion having a recess, and a container holder portion at an end thereof;*

*an armrest insert extending substantially an entire length of the armrest portion and entirely detachable from the armrest portion and when attached covers the recess when the main body is secured to the arm of the seat, wherein the armrest portion of the main body has a tongue and the armrest insert has a slot at a first end to receive the tongue, the tongue being inserted into the slot for retaining the armrest insert in the recess; and*

*means for mounting the main body on the arm of the seat, comprising a screw with a head, the head being positioned within the recess and hidden from view when the insert is attached to the main body, the head being accessible when the armrest insert is entirely detached from the armrest portion.*

* * * * *